US005222544A

United States Patent [19]

Dillon et al.

[11] Patent Number: 5,222,544

[45] Date of Patent: Jun. 29, 1993

[54] BONDING CASTING CORES

[75] Inventors: George A. Dillon, North Royalton; Gary J. Holodnak, Parma Heights; Nick Dadas, North Ridgeville, all of Ohio

[73] Assignee: Ford Motor company, Dearborn, Mich.

[21] Appl. No.: 744,189

[22] Filed: Aug. 12, 1991

[51] Int. Cl.[5] ..... B22C 9/10; B22C 9/12

[52] U.S. Cl. ..... 164/137; 34/4; 156/272.2

[58] Field of Search ..... 164/137, 369; 156/272.2, 275.7; 34/1 P, 4

[56] References Cited

U.S. PATENT DOCUMENTS

| | | | |
|---|---|---|---|
| 3,456,355 | 7/1969 | Cumming et al. | 34/1 P |
| 3,942,260 | 3/1976 | Nishitani | 34/4 |
| 4,180,918 | 1/1980 | Ostrowski | 34/4 X |
| 4,331,197 | 5/1982 | Cole . | |
| 4,655,276 | 4/1987 | Bird et al. . | |
| 4,728,531 | 3/1988 | Matz et al. | 34/4 X |
| 4,763,720 | 8/1988 | Sakamoto et al. . | |
| 4,954,681 | 9/1990 | Ishikawa et al. | 34/4 X |

FOREIGN PATENT DOCUMENTS

| | | | |
|---|---|---|---|
| 2101104 | 7/1971 | Fed. Rep. of Germany | 34/4 |
| 1407978 | 10/1975 | United Kingdom | 34/4 |

*Primary Examiner*—J. Reed Batten, Jr.

*Attorney, Agent, or Firm*—Joseph W. Malleck; Roger L. May

[57] ABSTRACT

Sand cores are bonded to form an assembly, using paste usually containing clay or silicates. Bonding is carried out by (a) coating at least one interfacing surface of intermating core parts with paste in a thickness of about 0.005–0.20 inches; (b) mating the coated interfacing surface of one core part to the other core part to form an assembly; and (c) subjecting the paste in the assembly to microwave energy at an energy level of about 5–7 kilowatts to effectively dry the paste in a manner proceeding first from the interior of the paste body to its outer peripheral extremities. The subjection to microwave energy draws the core parts closer together by shrinking the paste coating and by causing the paste to boil and drive the paste into pores and/or voids of the intermating core surfaces; such subjection is preferably carried out for a time period of 10–30 seconds.

6 Claims, 4 Drawing Sheets

BONDING CASTING CORES

BACKGROUND OF THE INVENTION

1. Technical Field

This invention relates to the technology of making multiple core assemblies, and more particularly to bonding surfaces of such cores to each other to eliminate flash therebetween as a result of casting.

2. Discussion of the Prior Art

Intermated sand cores are useful in large assemblies such as in automotive engine blocks and heads. Such cores are usually glued or pasted together, not locked by shaping, because multi-faceted cores with compound draft angles are difficult or impossible to form. Such pastes work well with sand cores constituted of 98% sand ($Sio_2$) and approximately 2% bonding agent. Conventional drying of such pasted cores, in a dry oven, causes poor casting quality, such as jacket separation in an engine block or plating or flash in waterjacket passages. This is caused by the fact that the core paste will dry from the outside. The paste will form a hard skin over the outer surface, inducing the paste to generate air bubbles therein; the paste will swell or expand as the paste dries further forcing the jackets to separate, resulting in major quality problems suggested above.

Drying of mold components by means other than conventional ovens, such as with microwave energy, has been used, but limited to refractory materials in cores with surface bonding materials. U.S. patents disclosing the use of microwave energy to dry core sand mixtures containing resins, include U.S. Pat. Nos. 4,763,720 and 4,331,197. U.S. Pat. No. 4,655,276 discloses the use of microwave energy to dry a refractory ceramic coating on a sand core applied in a slurry thickness in excess of 0.01 inch. It would not be readily suggestive to those skilled in the art to use microwave energy for drying wet pastes having a thickness in the range of 0.005–0.020 inches because of the fear of potential boiling of ultra-thin coatings and the resulting nonuniformity of the placement of the cores in the bonded condition.

SUMMARY OF THE INVENTION

The invention is, in a first aspect, an improved method of bonding sand cores to form an assembly, using paste usually containing clay or silicates. The method comprises: (a) coating at least one interfacing surface of intermating core parts with paste in a thickness of about 0.005–0.020 inches; (b) mating the coated interfacing surface of one core part to the other core part to form an assembly; and (c) subjecting the paste in the assembly to microwave energy at an energy level of about 5–7 kilowatts to effectively dry the paste in a manner proceeding first from the interior of the paste body to its outer peripheral extremities. The subjection to microwave energy draws the core parts closer together by shrinking the paste coating and by causing the paste to boil and drive the paste into pores and/or voids of the intermating core surfaces; such process is preferably carried out within a time period of 10–30 seconds.

A second aspect of this invention is a bonded sand core assembly for use in a metal casting process, comprising: (a) at least a pair of mating core components constituted of an agglomerated sand-comprising mixture; and (b) a paste coating between mating surfaces of the components having a dry thickness uniformly leveled and shrunken by microwave induced heating, said paste coating having dendritic-like tentacles extending into the pores of the mating surfaces to improve bonding.

BRIEF DESCRIPTION OF THE DRAWINGS

The novel features of the invention are set forth with particularity in the appended claims. The invention itself, however, both as to its organization and method of operation, together with further objects and advantages thereof, may best be understood by reference to the following description taken in conjunction with the accompanying drawings, in which:

DETAILED DESCRIPTION AND BEST MODE

Core paste is often used to bond two or more sand cores together to eliminate parting flash (metal that enters into the parting surfaces between such cores). The core paste is useful even though the complex core assemblies use core prints to locate and nest the cores together. Complex core assemblies are often used for such automotive components as heads for internal combustion engines with multi-cylinders, or in engine blocks which have a variety of internal passages that must be defined by a multiple core assembly.

Figure 1:
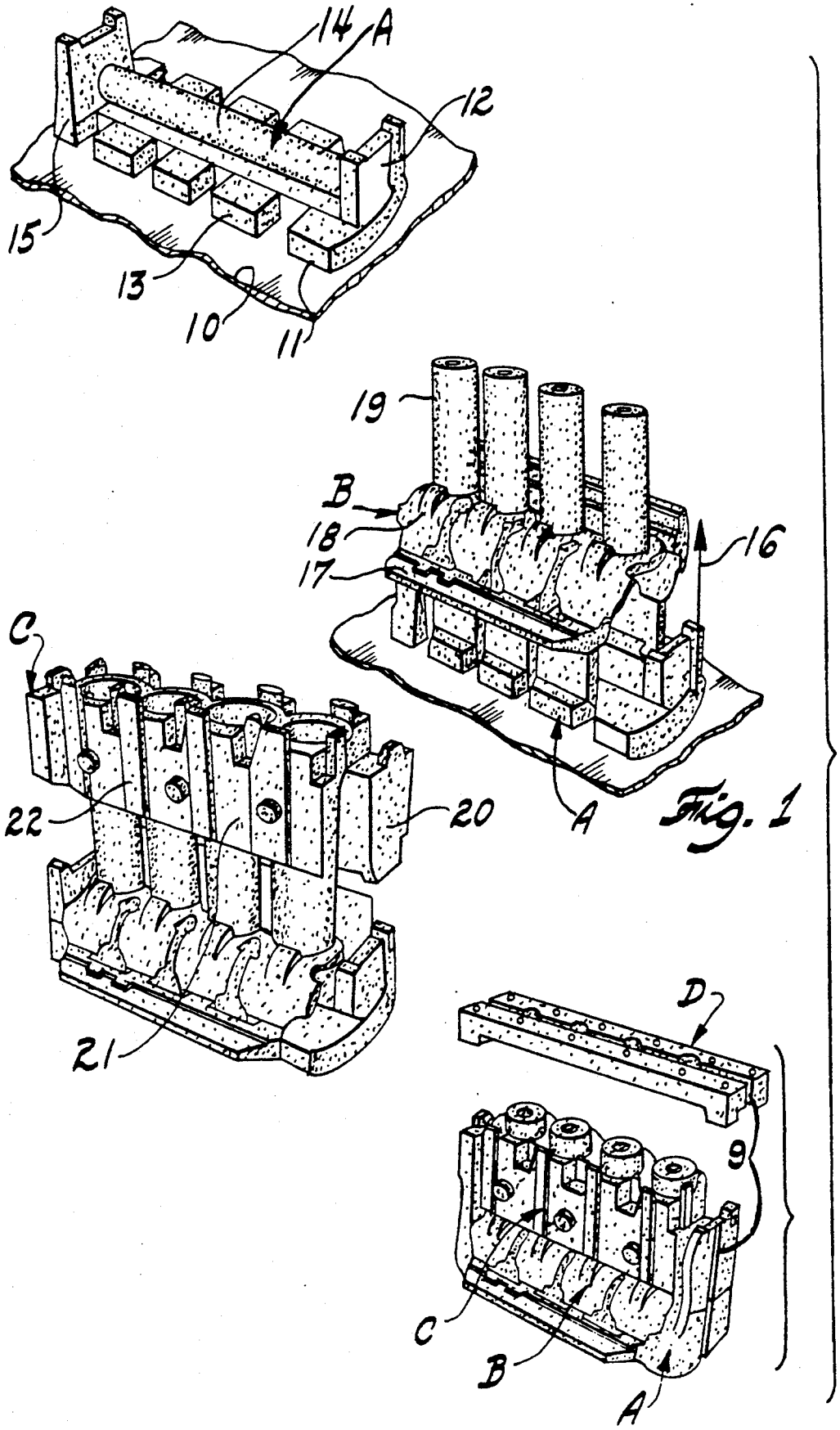
FIG. 1 is a schematic illustration, in sequence, of cores to form a complex assembly.

As shown in FIG. 1, a plurality of individual sand core components are made to nest together to be used as a single unit in a metal casting operation for an engine block. Four individual core components may be prepared, including a journal core A, a crankcase and barrel core B, a waterjacket core C, and a head slab core D. These cores are used in defining the internal passages and spaces that are necessary for an internal combustion engine block. The cores are formed of a suitable sand mixture employing a binder, preferably in the form of a furan resin which, when cured by heat, forms a rigid sand structure. Other binders may be employed which are cured without the use of heat to achieve equivalent purposes.

The technology for making sand cores is more fully disclosed in "Foundry Core Practice", by H. Jietert, published by American Foundryman's Society, 1966, and which is incorporated herein by reference. Such technology typically comprises blowing the sand mixture into a core box having an appropriate interior cavity designed for the specific core; the impaction from blowing forces shapes the sand grains into a dense condition.

Typically, the cores are assembled in a sequence such as shown in FIG. 1 where the journal core A is placed on a platform 10 with its base surface 11 resting thereon. The journal core comprises shaft space part 14, locator space part or print 13, and end wall prints 12 and 15. The next core (the crankcase and barrel core B) is placed thereover in spaced relationship with the journal core. The cores A and B are stacked on top of one another as shown in FIG. 1 in a preferred orientation 16 which is vertical to the platform upon which the journal core rests; cores A and B are shown separated to illustrate the direction of nesting. Core B comprises cylinder bore parts 19, crankcase cavity space parts 18, and locator flange space parts 17. Core C comprises waterjacket parts 21, water circulation opening parts 22, and end locator parts or prints 20. Core D is an entire print or slab with a depending skirt and rests on the upper portion of the assembled cores B and C.

From the above can be observed the intricacy of the various intermating surfaces of the four major core parts. Each major core is made up of parts that may be pasted together. These intermating or interfitting surfaces, if not properly closed by paste, will permit flash to occur.

Conventional drying, using a paste dry oven, is one of the main causes of poor quality in castings such as jacket separation, plating, or flash in the waterjacket passage. Conventional drying causes core paste to dry from the outside. The paste forms a hard skin 25 over the outer surface, which causes the paste to generate air bubbles 26, swell and expand in the process of drying forcing the core jackets to separate to a new position 27 (see FIG. 4), causing major quality problems as indicated above.

To avoid flash, core surface bubbles, inadequate part coverage, and dimensional distortion as well as reduce core assembly time when using paste to close the mating surfaces of a multiple core assembly, the invention herein proposes the following process: (a) coat at least one interfacing surface of the multiple core assembly with the paste in a thickness of about 0.005–0.025 inches; (b) mate the coated interfacing surfaces to form an assembly; and (c) subject the paste in the assembly to microwave energy at an energy level of about 5–7 kilowatts to effectively dry the paste in a manner proceeding first from the interior of the paste body to its outer peripheral extremities. Microwave energy is comprised of electromagnetic waves lying between the far infrared frequency and some lower frequency limit, usually between 300,000 and 300 megahertz. This high energy causes the paste to boil, which drives and forces the paste into the core voids. This also forces the paste to level out on contacting surfaces, pull the cores together, and create a tighter seal to eliminate separations and prevent metal from flowing thereinto.

The coating technique may be carried out in any suitable manner such as by brushing, extruding, or applying with a pasted printer or surface. The interfitting surfaces of mating cores can all lie in a straight plane or can be in a uniform curvature that facilitates nesting of the cores together.

The paste typically used to coat the interfitting surfaces of the cores may be selected from a variety of paste materials such as clay, resin, or silicate based preferably soluble in water. The paste should be applied in a thickness range of 0.005–0.025 inches and preferably should coat the entire mating surface.

Increased productivity is a by-product of this method. A conventional oven requires 20–40 minutes of time to dry the cores, illustrated in FIGS. 2 and 3, whereas the microwave energy technique herein requires 10–20 seconds.

Figure 2:
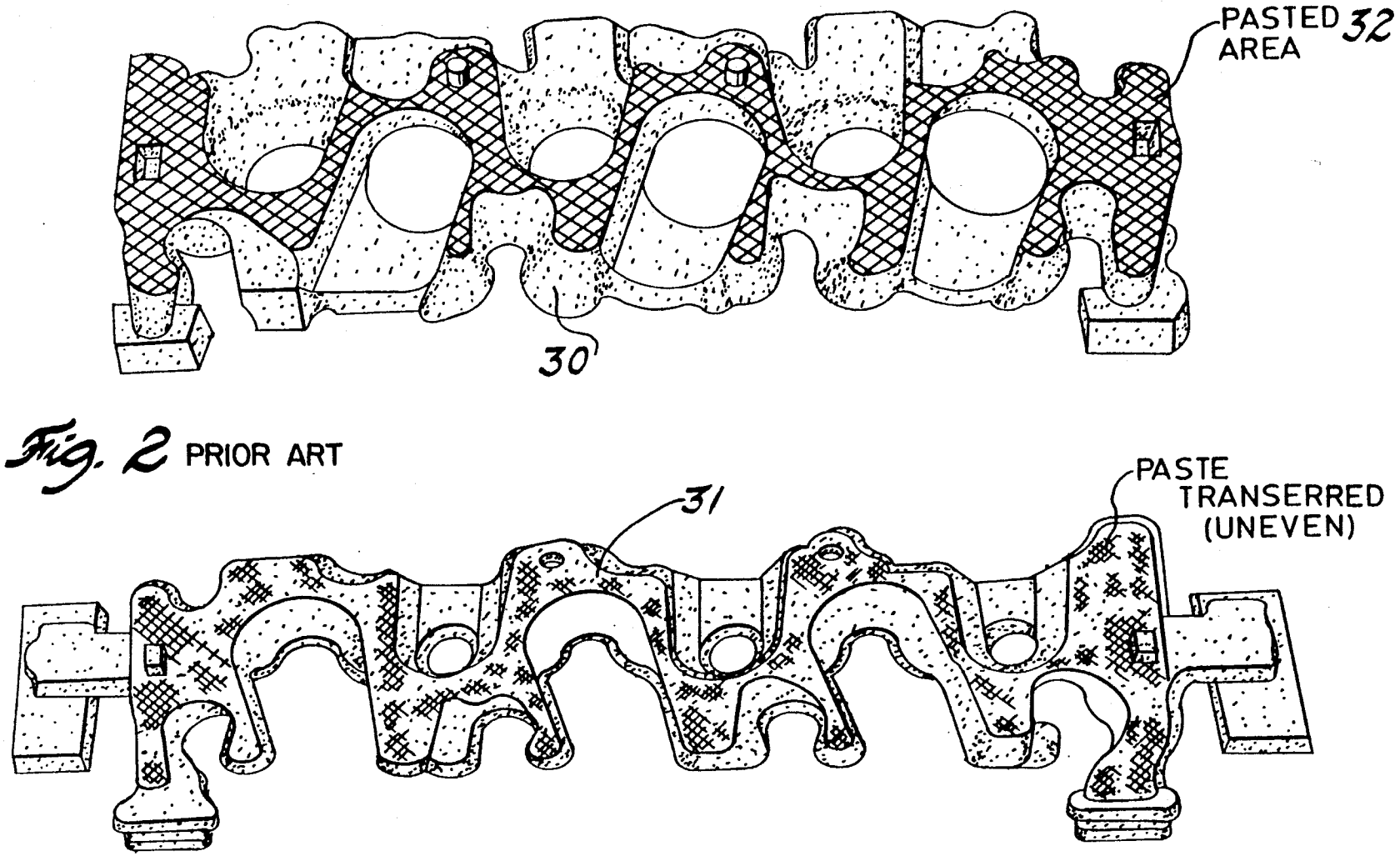
Fig. 2 PRIOR ART
FIG. 2 is a composite of first and second intermating core components in which the first core has been previously coated with a paste on one side only, the second core having been assembled and dried in a conventional oven at a drying time of 10–20 seconds.

Certain samples were prepared to demonstrate the effectiveness of this inventive method. As shown in FIG. 2, mateable parts 30 and 31 for a single head core were coated by pasting only part 30 along the surfaces indicated in cross-hatching 32. Such cross-hatched surfaces covered a considerable portion of the exposed surface of the part. After the core parts 30 and 31 were mated together and subjected to conventional oven drying at a temperature of about 330° F. for a period of about 20 minutes, the mating core was separated. The condition of the mated surfaces is as shown in FIG. 2. A spotty distribution of the transferred paste from part 30 appears on core part 31 at complementary surface areas.

Figure 3:
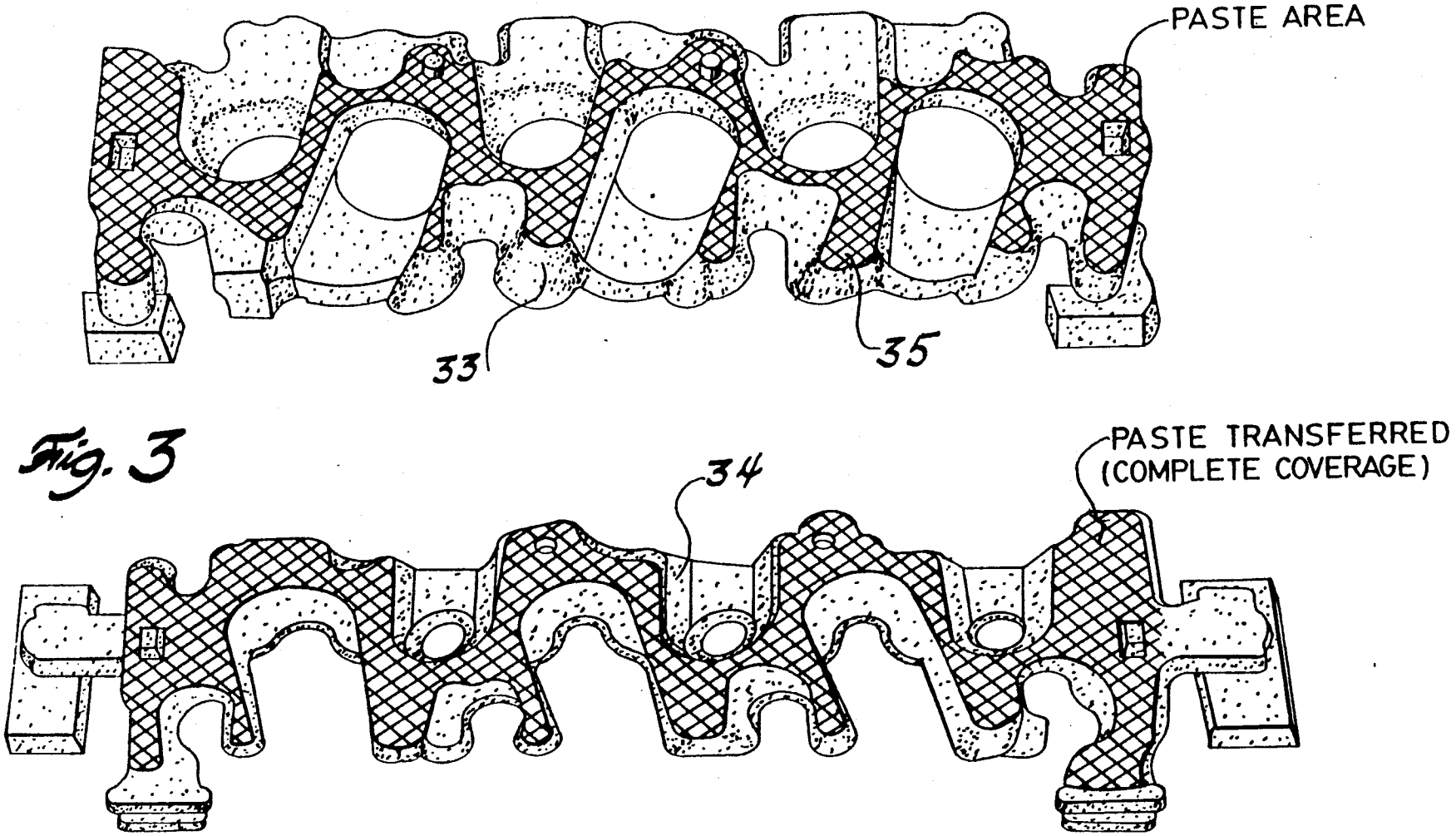
FIG. 3 is a composite view of first and second intermating cores having a bonding paste applied to one side only of one of the core components and then assembled, the cores having been subjected to microwave drying for a period of 10–20 seconds.

Interfitting head core parts 33 and 34, of the type in FIG. 2, were prepared by coating only one part 33 on one side only at 35, as shown in FIG. 3. However, this time the intermated core parts were subjected to microwave drying at an energy level of about 6 kilowatts for a period of about 10 seconds and the cores then separated. As shown in the bottom portion of FIG. 3, the bottom core part shows a uniform distribution or transfer of the paste from one core part to the other.

Figure 4:
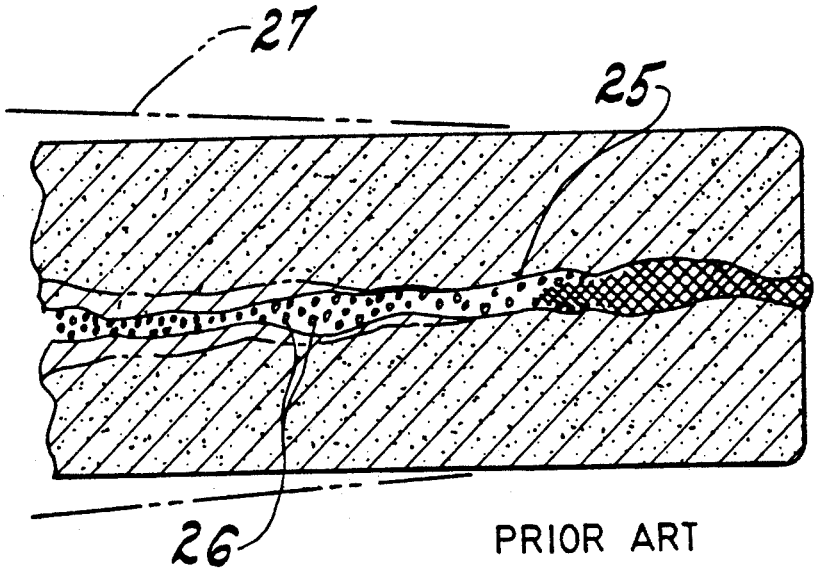
FIG. 4 is an enlarged schematic sectional view of intermating bonding surfaces conventionally dried in accordance with the prior art and showing the paste having dried from the outside margins toward its center with the central regions exhibiting distortion and expansion, causing the core components to move.
Figure 5:
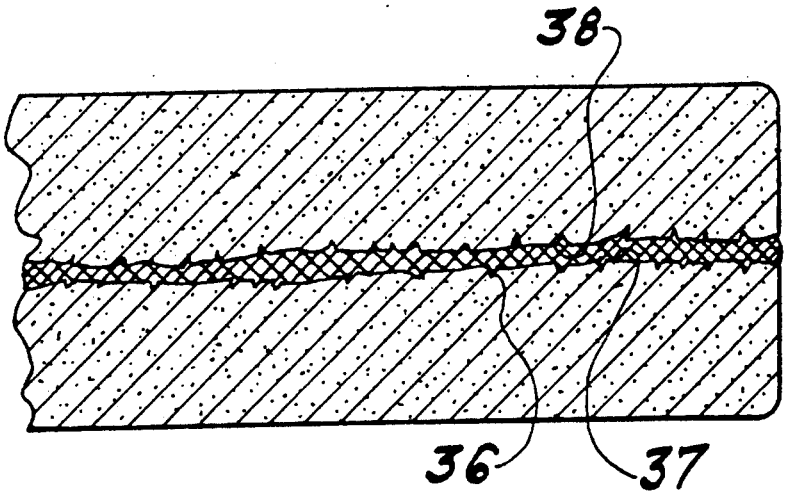
FIG. 5 is a view similar to that of FIG. 4 representing an enlarged sectional view through intermating core components which have been dried using the method of this invention and thereby showing the improved bond.

Specimens examined of the conventionally heated core parts showed a number of air bubbles that were formed within the interior layers of the paste which, in turn, caused swelling or expansion in the process of drying forcing the mating walls apart slightly (as shown in FIG. 4). However, when the microwave heated cores were examined, the paste layer was seen to have formed dendritic-like tentacles 36 extending into the pores of the mating surfaces 37, 38. The high rate of energy caused the paste to boil and drive the paste into the core voids. This also forced the paste to level out on the contacting surfaces, creating a very uniform dimensional alignment, and caused the cores to be pulled together creating a tighter seal to eliminate separation.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

We claim:

1. An improved method of bonding sand core parts to form an assembly using paste, comprising the following steps:

(a) coating at least one of interfacing surfaces of said core parts with said paste in a thickness of about 0.005–0.025 inches;

(b) mating said coated interfacing surfaces to form an assembly; and (c) subjecting at least said paste in said assembly to microwave energy at an energy level of about 5–7 kilowatts to effectively dry said paste proceeding in a manner first from the interior of the paste body to its peripheral extremities.

2. The method as in claim 1, in which said paste is clay, resin, or silicate based.

3. The method as in claim 1, in which said paste spreads out uniformly during step (c) to draw said core parts closer together.

4. The method as in claim 1, in which during step (c) said paste boils to drive such paste into at least one of pores and voids of the core part surfaces.

5. The method as in claim 1, in which the time for step (c) is in the range of 10–30 seconds.

6. A bonded sand core assembly for use in a metal casting process, comprising:

(a) at least one pair of mating core parts constituted of a densified agglomerated sand; and (b) a paste coating between mating surfaces of said parts having a dry thickness uniformly leveled and shrunken by microwave induced heating, said paste coating having dendritic-like tentacles extending into the pores of said mating surfaces to improve bonding.

* * * * *